United States Patent [19]

Beine

[11] Patent Number: 4,739,601

[45] Date of Patent: Apr. 26, 1988

[54] CONSTRUCTION ANCHOR CHANNEL

[75] Inventor: Karlheinz Beine, Ratingen, Fed. Rep. of Germany

[73] Assignee: Halfeneisen GmbH & Co. Kommanditgesellschaft, Dusseldorf, Fed. Rep. of Germany

[21] Appl. No.: 945,034

[22] Filed: Dec. 22, 1986

[30] Foreign Application Priority Data

Dec. 24, 1985 [DE] Fed. Rep. of Germany ..... 3546107

[51] Int. Cl.[4] ..... E04B 1/38

[52] U.S. Cl. ..... 52/710; 29/432

[58] Field of Search ..... 52/709, 710, 699, 711; 411/83, 81, 412, 413; 29/432, 432.1

[56] References Cited

U.S. PATENT DOCUMENTS

| | | | |
|---|---|---|---|
| 589,424 | 9/1897 | Evans | 411/83 |
| 2,593,506 | 4/1952 | Wales | 29/432.1 |
| 2,672,659 | 3/1954 | Becker | 411/83 |
| 3,418,013 | 12/1968 | Kelly | 411/81 |
| 3,537,288 | 11/1970 | Ansingh | 411/412 |
| 4,052,833 | 10/1977 | Beine | 52/710 |
| 4,571,912 | 2/1986 | Fricker | 52/710 |

FOREIGN PATENT DOCUMENTS

| | | | |
|---|---|---|---|
| 0090453 | 5/1983 | European Pat. Off. | 411/412 |
| 901681 | 7/1962 | United Kingdom | 52/701 |

*Primary Examiner*—James L. Ridgill, Jr.
*Attorney, Agent, or Firm*—Collard, Roe & Galgano

[57] ABSTRACT

An anchor channel for use in the construction industry is provided having outwardly directed protuberances in the web of the channel with openings therethrough which are penetrated by the shaft of an anchor bolt. The bevel of the countersunk head of the anchor bolt is fitted tightly in the protuberance the inner surface of which due to material deformation is attached by a press fit to the circumferential surface of the anchor bolt. The inner surface of the opening is the shape of a truncated cone and arranged with the smaller diameter directed toward the web of the channel. The thereby formed wedge between the surface of the opening and the anchor bolt is filled by squeezing or upsetting a connecting section of the anchor bolt which has a greater cross-section or diameter and projects along the anchor bolt shaft from the countersunk head of the anchor bolt.

8 Claims, 4 Drawing Sheets

V
V
1
2
3
4
5
6
8
9
10
11
12
18'
18''
18'''
18''''

CONSTRUCTION ANCHOR CHANNEL

The present invention relates to an anchor channel for use in the building or construction industry having upwardly extending protuberances in the web of the channel with openings through which the shaft of an anchor bolt extends. The countersunk head of the bolt is fitted tightly in the protuberance, the inner surface of which is joined with the circumferential surface of the anchor bolt by a press fit effected by material deformation.

A similar type of anchor channel is disclosed in DE-PS No. 3 407 801, wherein the anchor bolt comprises a countersunk bolt with an outside thread over the entire shaft. The protuberance continues into an outwardly directed neck which is pressed against the shaft next to the countersunk head. This embodiment does not possess adequate stability. The transition zone between the countersunk head and the shaft is the region of greatest risk of fracture. It is very difficult using a deformation technique to produce a material-wise adequately strong neck. A reliable, tight fitting of the bevel of the countersunk head to the protuberance during the squeezing or upsetting of the neck can only be ensured at considerable cost.

An embodiment is also known wherein the anchor element is approximately the shape of an I-section. From the support flange directed toward the web of the channel a conically shaped plug-in end projects. It penetrates the opening and is then upset. Thus, the front end forms a rivet like head which essentially is countersunk positioned in the protuberance. However, invariably after the riveting operation a certain re-deformation takes place which reduces the stability of the joint between the anchor bolt and the anchor channel.

It is, therefore, the object of the present invention to develop an anchor channel of the type described above using a simple production method in such a way that, in addition to an extremely stable fitting of the anchor bolt in the anchor channel, in the transition area between the bevel of the countersunk head and the shaft no fracture zone can develop that would reduce the load carrying capacity of the construction element.

The above object is accomplished in accordance with the present invention by an anchor channel having outwardly directed protuberances in the web thereof each with an opening through which extends the shaft of an anchor bolt which is tightly fitted with the bevel of its countersunk head in the protuberance. The inner surface of the opening in the protuberance, as a result of material deformation, is secured by a press fit to the circumferential surface of the anchor bolt. This is accomplished by the inner surface of the opening being in the shape of a truncated cone arranged with the smaller diameter towards the web of the channel. The wedge resulting from the bolt extending through the opening is filled by the upsetting of a connecting section of the anchor bolt which extends longitudinally from the countersunk head and which has a larger diameter than the bolt.

As a result of such a construction a class conforming anchor channel is formed which is marked by high durability and stability. Th formlocking achieved between the anchor bolt and the anchor channel is optimal using the method of the present invention. Therefore, high stresses can be absorbed without causing damage. For the first time a connecting section projecting from the countersunk head is riveted in such a way that during the riveting process the wedge between the inner surface of the opening and the connecting section is completely filled. In particular this can be accomplished by cold forming, whereby the connecting section adjacent to the countersunk head leads to a uniform higher strength in the transition area between the bevel of the countersink and the connecting section which ensures that in this area a region with a tendency to fracture does not develop. The corresponding shape of the cross section of the opening has the effect that no re-deformations occur which could promote an eventual loosening of the anchor bolt. The upsetting pressure continues to the protuberance thereby effecting a tight fit of the protuberance with the bevel of the countersunk head. This joint is even liquid tight. Hairline cracks which would permit an infiltration of moisture cannot develop.

The opening in the web of the channel is first punched or drilled in order to obtain the corresponding truncated cone shaped configurations of the inner surface of the opening. By then pressing out the protuberance, the inner surface of the opening assumes its truncated cone shaped form. This leads to a simplification of fabrication and, therefore, lower production costs. By a corresponding greater expansion of the material at the outside of the protuberance the opening breaks out during punching in the shape of a truncated cone. The punching of the opening can also be performed in between the embossing of the protuberances. It is preferable to make up each protuberance of several individual sections angularly linked with each other. The central section serves to accommodate the bevel of the countersunk head while the one or more adjacent sections lead to a stiffening of the web of the channel which increases stability under load and reduces deformations occurring under stress. This is assisted in particular by providing on both sides of the fitting area of the countersunk head a bridge like embossed section which is arched toward the interior of the channel.

In order to ensure among other things a reliable, stable positioning of the anchor bolt during thread rolling, two threaded sections are provided at its free end, between which a section has been left without threads. By this means a dual function has been achieved. On the one hand the threaded sections can be machined more favorably, and on the other hand these threaded sections provide for the fitting of a nut which is self checking against the two threaded sections and is thereby secured against turning. An obvious further advantage is that the minor thread diameter of the threaded sections is smaller than the diameter of the intermediate section. This results in a simplification of machining.

Finally, it is advantageous from the perspective of stress design that the inner surface of the opening is substantially perpendicular to the surface of the truncated cone of the countersunk head, that is of the bevel of the countersunk head. The outer threaded section must be slightly larger than the height of a corresponding nut. Eventually it can be longer than the height of the nut.

Other objects and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views.

Figures 4, 4A:
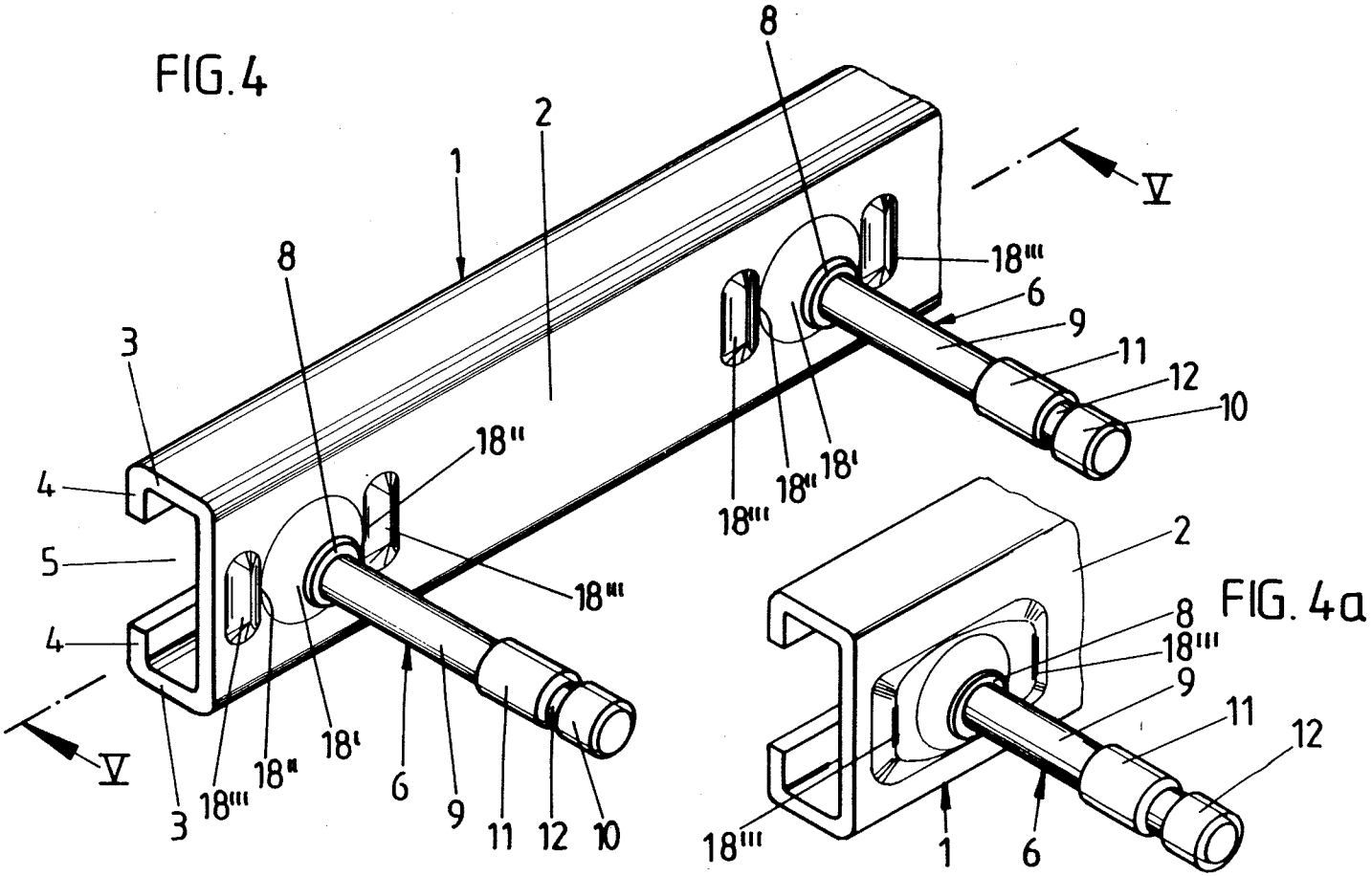
FIG. 4 is a perspective view of the anchor channel with attached anchor bolt according to another embodiment of the present invention.
Figure 5:
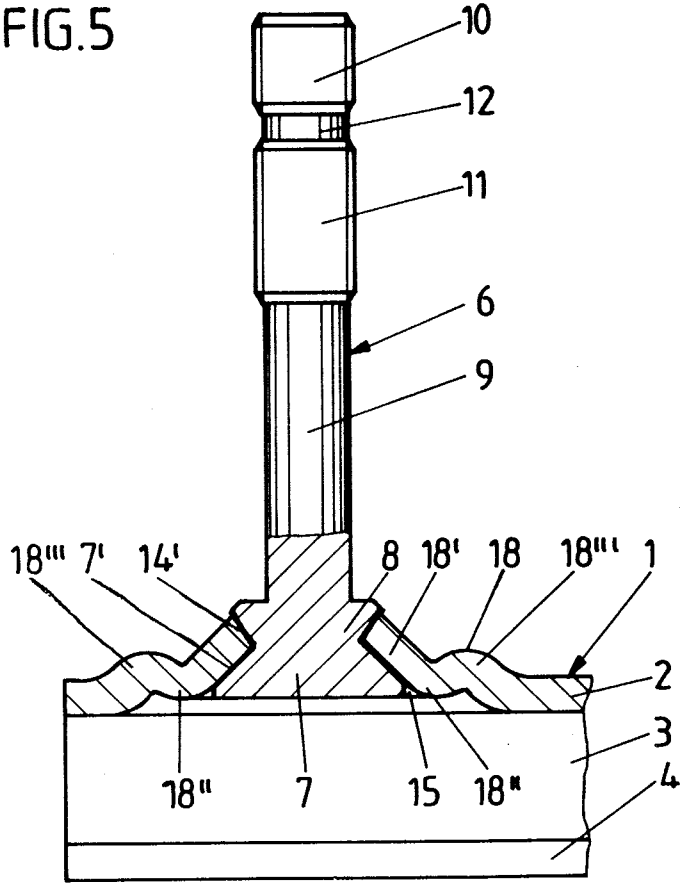

FIG. 4*a* is a perspective view of a variation of the embodiment shown in FIG. 4;

FIG. 5 is a cross-sectional view taken along line V—V of FIG. 4; and

Figure 6:
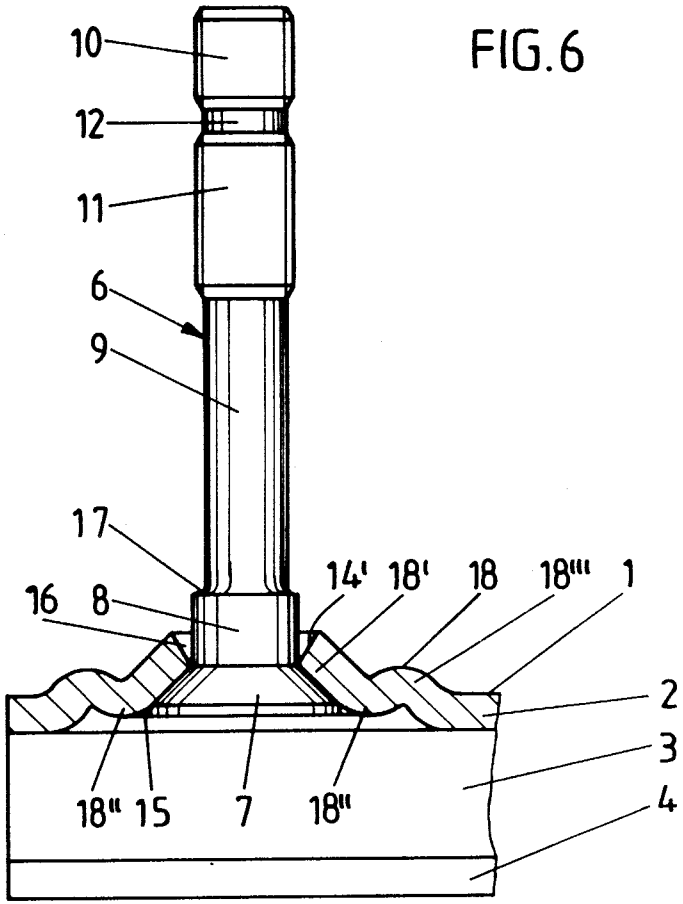

FIG. 6 is a part cross-sectional view similar to FIG. 5 but before the upsetting operation.

Figure 1:
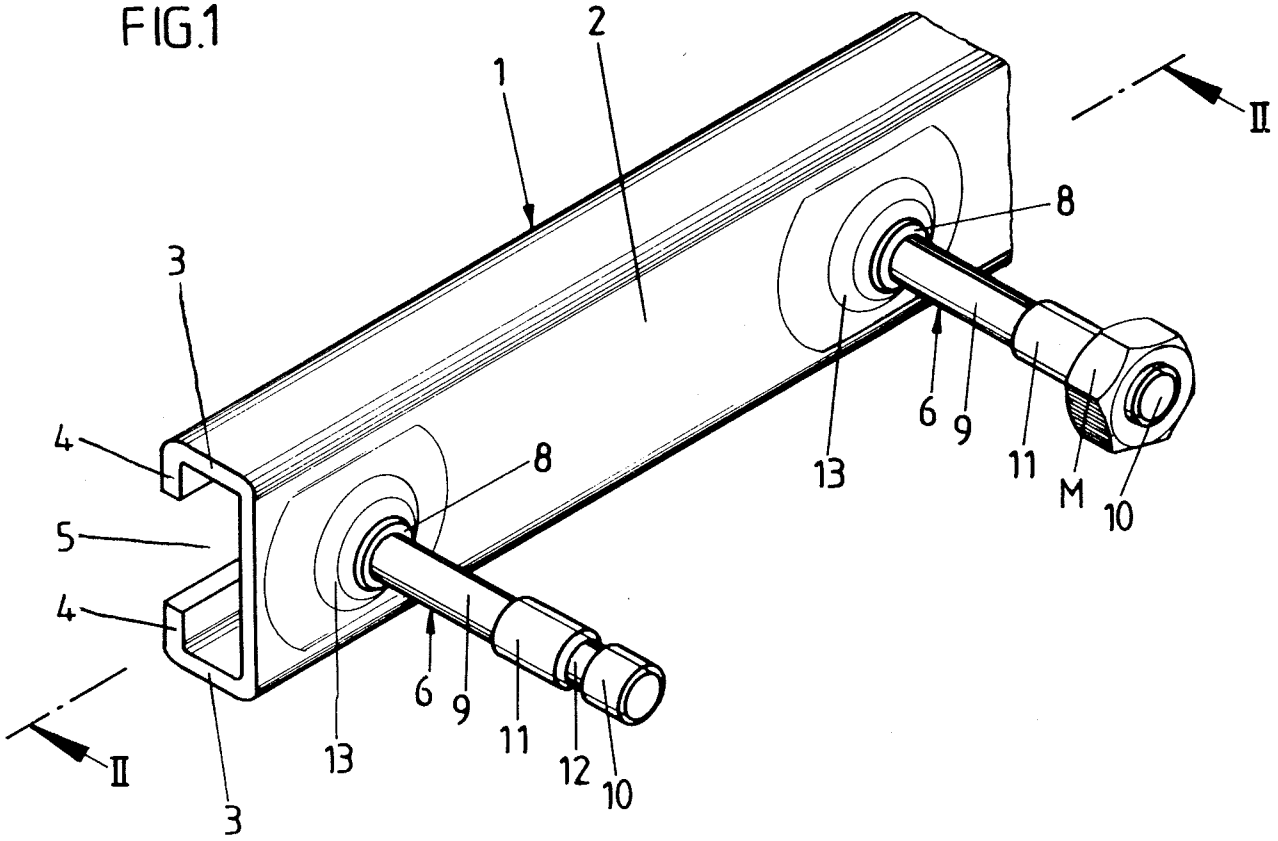
FIG. 1 is a perspective view of the anchor channel with the attached anchor bolt according to the present invention.

Now turning to the drawings, there is shown in FIG. 1 an anchor channel 1 having a C-profile. In particular, anchor channel 1 consists of web 2, flanges 3 at a right angle to web 2, and lips 4 which are formed by bending the ends of flanges 3 inwardly so that a longitudinal slot 5 results for inserting mounting elements (not shown).

From web 2 of channel 1 anchor bolts 6 project at a predetermined distance from each other. Each anchor bolt, as clearly seen in FIGS. 2 and 3, includes a countersunk head 7. Countersunk head 7 is joined by a connecting section 8 which continues into a shaft 9 with an off set cross section. The length x of connecting section 8 has a greater cross section in relation to shaft 9 and is about twice as large in length as wall thickness y of the anchor channel.

At its free end anchor bolt 6 is provided with two threaded sections 10 and 11 located one behind the other, between them a bolt section 12 remains without threads. Threaded section 10 at the end of the bolt is shorter than threaded section 11 arranged before it and accommodates the anchor nut M. The diameter of bolt section 12 is equal to the diameter of shaft 9. This means that threaded sections 10 and 11 have a greater diameter than shaft 9. However, the minor thread diameter of threaded sections 10 and 11 is smaller than the diameter of bolt section 12. On threaded section 10 a nut can be fastened which is then in counter check against section 12, or eventually against the thread of section 11, or against a counter nut positioned there.

For the fastening of anchor bolt 6, the anchor channel includes two protuberances 13 which are upwardly directed and provided in the center with an opening 14.

Figure 3:
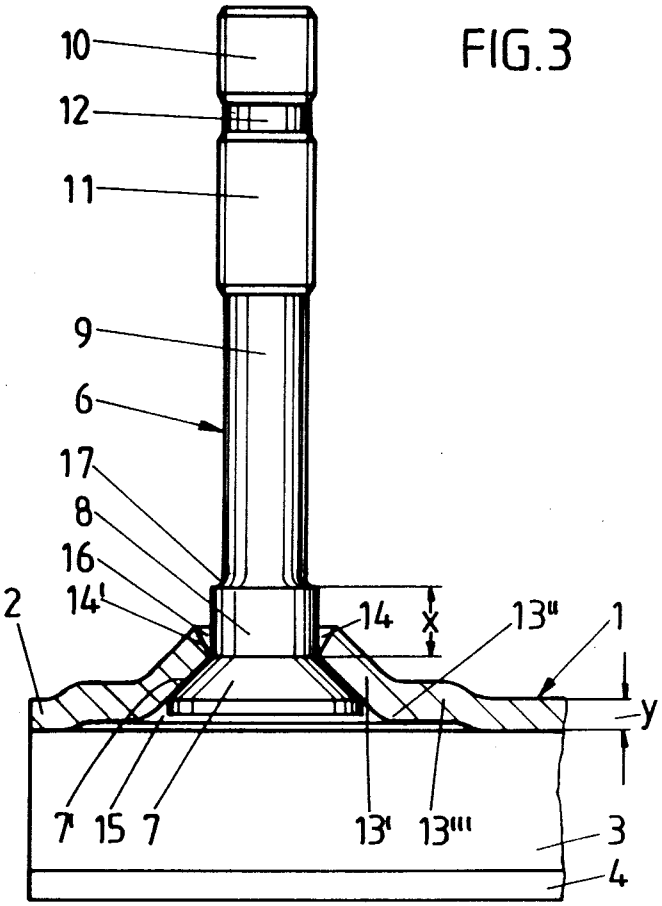
FIG. 3 is a part cross-sectional view similar to FIG. 2 but before the upsetting operation.
Figure 2:
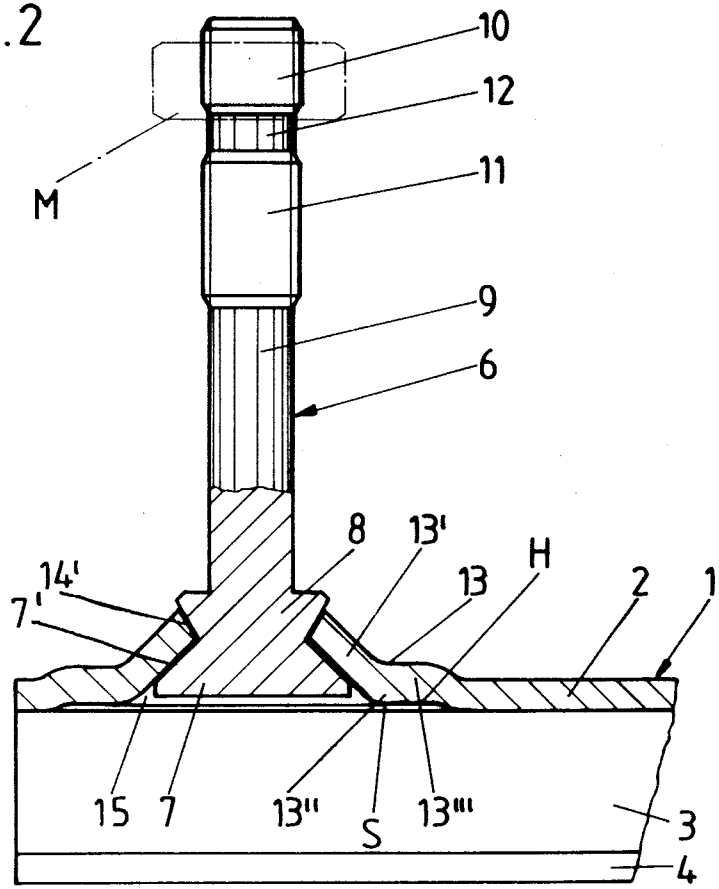
FIG. 2 is a cross-sectional view taken along line II—II of FIG. 1.

As seen in FIGS. 1 to 3, each protuberance consists of three individual embossed sections 13', 13" and 13"' angularly joined one to another. In an especially purposeful embodiment they are arranged concentrically. The middle embossed section 13" is located outside bolt head mounting area 15 of the protuberance and runs approximately parallel to the plane defined by the underside of web 20 of channel 1. Thus, crown S of embossed section 3" limits cavity H of embossed edge section 13"' at a plane lying somewhat higher than the inner surface of the channel.

Opening 14 is produced by punching from the interior of the channel after protuberance 13 has been formed. Inner surface 14' of the opening is the shape of a truncated cone with the larger diameter directed away from the web of the channel. The smaller diameter of opening 14 is about the same as the outside diameter of connecting section 8. When anchor bolt 6 is inserted from the inside of the channel, connecting section 8 penetrates opening 14 while bevel 7' of countersunk head 7 fits tightly against the inner wall of central section 13'. In this way a circumferential wedge 16, shaped like a ring, is formed between inner surface 14' of the opening and connecting section 8. Wedge 16 is filled by the subsequent squeezing or upsetting of connecting section 8, as clearly seen in FIG. 2. The corresponding squeezing tool (not shown) attacks at step 17 between shaft 9 and connecting section 8. The upsetting process effects a strain hardening of the material. Connecting section 8 is shortened thoroughly. At the same time wedge 16 is filled out leading to a stable, formlocking press fit connection of anchor bolt 6 with anchor channel 1. The upsetting pressure continues into the wall of opening 14 and effects a tight fit of the corresponding area of connecting section 8 at inner surface 14' of the opening. From FIG. 2 it can be seen that inner surface 14' of the opening is arranged approximately perpendicular to the surface of bevel 7' of countersunk head 7.

According to the embodiment shown in FIGS. 4 to 6, anchor bolt 6 has the same configuration but protuberance 18 has a different cross section. Specifically, it has a central section 18' with opening 14 therethrough. On both sides of the mounting space for the countersunk head, bridge like embossed sections 18" extend which go over into the outwardly arched embossed sections 18"'. This cross section profile also provides a stiffening in the area of the protuberance 18 resulting in a position stabilization of the anchor bolt mounted on web 2 of the channel. The fitting of the anchor bolt proceeds as described above.

The difference between FIG. 4 and FIG. 4*a* is that in FIG. 4*a* the sections 18"' are subparts of a general embodiment, so that the bridge like arching occurs over the whole width of the protuberance and not only in the longitudinal section plane of the anchor bolt.

In an alternate embodiment the free end of the anchor bolt can be provided with an upset anchor head instead of the threaded sections with nuts. The upset anchor head having a larger cross section than the shaft fulfills the same task, namely, the creation of a support for the anchor channel in the embedding material and it can be fabricated at a lower cost. If it has the larger diameter then the upsetting is done after the fitting of the anchor bolts in the channel, whereby the connecting section is again useful especially in regards to step 17.

While several embodiments of the present invention have been shown and described, it will be obvious that many changes and modifications may be made thereunto without departing from the spirit and scope of the invention.

What is claimed is:

1. An anchor channel with anchor bolt having a bevelled head for use in the construction industry, comprising at least one outwardly directed protuberance in a web of the channel, and an opening in the protuberance penetrated by the shaft of the anchor bolt tightly fitted with the bevel of its countersunk head in a mounting space formed by the protuberance, the inner surface of the opening being in the shape of a truncated cone and arranged with the smaller diameter directed towards the web of the channel, the wedge resulting from the penetration of the opening by the bolt being filled with material of the bolt by the upsetting of a connecting section of the anchor bolt having a greater diameter than the shaft thereof and projecting longitudinally from the countersunk head so that as a result of the material deformation the inner surface of the opening is attached by a press fit to the circumferential surface of the anchor bolt.

2. The anchor channel according to claim 1, wherein the inner surface of the opening is arranged approximately perpendicular to the surface of the truncated cone of the inner surface of the opening in the protuberance.

3. The anchor channel according to claim 1, wherein said protuberance is formed of several individual embossed sections linked angularly with each other.

4. The anchor channel according to claim 3, wherein at least one embossment is provided at both sides of the mounting space for the countersunk head, arched bridge like toward the interior of the channel.

5. The anchor channel according to claim 1, wherein the anchor bolt is provided at its free end with two longitudinally separated threaded sections between which a bolt section is provided without threads.

6. The anchor channel according to claim 5, wherein the minor thread diameter of the threaded sections is smaller than the diameter of the intermediate bolt section.

7. The anchor channel according to claim 1, wherein the anchor bolt has an upset anchor head at its free end.

8. The anchor channel according to claim 7, wherein the cross section of the upset is larger than the diameter of the connecting section.

* * * * *